US005950779A

United States Patent [19]

Miyoshi

[11] Patent Number: 5,950,779

[45] Date of Patent: Sep. 14, 1999

[54] BAG MOUNTED WITH CASTERS

[75] Inventor: Etsuo Miyoshi, Okawa-gun, Japan

[73] Assignee: Swany Corporation, Kagawa, Japan

[21] Appl. No.: 08/947,144

[22] Filed: Oct. 8, 1997

[30] Foreign Application Priority Data

Oct. 21, 1996 [JP] Japan ..... 8-298264

[51] Int. Cl.[6] ..... A45C 5/14; A45C 13/04; A45C 13/26; A45C 13/36

[52] U.S. Cl. ..... 190/18 A; 190/39; 190/24; 190/112; 190/115; 190/127

[58] Field of Search ..... 190/18 A, 115, 190/39, 112, 122, 127, 24

[56] References Cited

U.S. PATENT DOCUMENTS

| | | | |
|---|---|---|---|
| 513,726 | 1/1894 | Potts | 190/115 X |
| 4,679,670 | 7/1987 | Wickman | 190/18 A |
| 4,759,431 | 7/1988 | King et al. | 190/18 A |
| 4,995,487 | 2/1991 | Plath . | |
| 5,054,589 | 10/1991 | Bomes et al. | 190/18 A |
| 5,181,590 | 1/1993 | Carpenter et al. | 190/18 A |
| 5,474,162 | 12/1995 | Shyr et al. | 190/18 A |
| 5,564,538 | 10/1996 | Sadow | 190/18 A |
| 5,566,797 | 10/1996 | Van Himbeeck | 190/115 X |
| 5,672,168 | 9/1997 | Miyoshi | 190/18 A |

FOREIGN PATENT DOCUMENTS

| | | | |
|---|---|---|---|
| 57-71419 | 10/1982 | Japan . | |
| 57-179824 | 11/1982 | Japan . | |
| 58-93224 | 6/1983 | Japan . | |
| 60-164918 | 11/1985 | Japan . | |
| 61-163518 | 10/1986 | Japan . | |
| 63-131634 | 8/1988 | Japan . | |
| 64-10202 | 2/1989 | Japan . | |
| 4-76686 | 12/1992 | Japan . | |
| 7-39544 | 7/1995 | Japan . | |
| 1073104 | 6/1967 | United Kingdom | 190/115 |

*Primary Examiner*—Sue A. Weaver
*Attorney, Agent, or Firm*—Wenderoth, Lind & Ponack, L.L.P.

[57] ABSTRACT

A bag is provided and includes a freely opening and closing bag body, casters allowing the bag to be moved in the self standing upright posture and fixed at the lower face of the bag body, and a handle which is freely extensible inwardly and outwardly of the bag body. The handle has a grip at its upper extremity and connects vertical rods at both extremities of the grip. The vertical rods are introduced into guide pipes fixed to the bag body so as to be freely extensible. The interior of the bag body is divided into two compartments with one on each side by the partition fixed at the bag body. The bag body has covers which open and close each compartment, and the guide pipes are fixed to the partition.

16 Claims, 11 Drawing Sheets

BAG MOUNTED WITH CASTERS

BACKGROUND OF THE INVENTION

The present invention relates to a bag mounted with casters, and especially to a bag having a vertically extensible handle. The bag of the present invention is used in the broad meaning of suitcases and attache-cases.

Bags provided with casters and a freely extensible handle have already been developed and widely used. Many types of bags having this structure can be boarded on planes. For example, bags of this structure have been mentioned in the description of U.S. Pat. No. 4,995,487; Japanese Patent Publication No. 4-76686 issued Dec. 4, 1992; and Japanese Non-examined Utility Model Publications Nos. 57-179824 issued Nov. 15, 1982 and 63-131634 issued Aug. 29, 1988. The bags mentioned in these publications are provided with two casters mounted on one side of a bottom face as shown in FIG. 1. The short legs 2 are fixed on an opposite side of the bottom face. When the bag is in a vertical position, the casters 1 and the legs 2 are in contact with the floor. In this condition, because the legs 2 which do not turn are in contact with the floor, the bag can stand upright without moving. Further, to allow the bag to be pulled, an extensible handle 3 is provided at an upper face of the bag. The casters 1 are mounted on the same side of the bag as the handle 3, because the bag is pulled while in a slanted or tilted orientation. As shown in FIG. 1, the bag can be moved when it is titled and pulled by the handle 3. When the bag is titled, the casters 1 are in contact with the floor and the legs 2 are not in contact with the floor. When the handle 3 is pulled in this condition, the casters 1 freely turn so as to facilitate movement of the bag. However, with bags that move in this fashion, the casters 1 cannot sometimes be used in narrow places like in the aisles of a plane or in a crowded area. When the bag is moved with the casters 1, the width of the bag is wider, and the bag cannot be moved freely in the aisles between the seats in the cabin of a plane, or in crowded areas. When the casters 1 cannot be used, it is necessary to lift the bag and carry it by hand. When the bag is lifted and carried by hand, it is possible to move the bag in the direction shown by arrow A of FIG. 1 in order to prevent the widest dimension of the bag from extending transversely relative to the direction of travel.

The bag mounted with casters has a convenient structure allowing it to be moved easily. This is because even if the bag is heavy, it is easily pulled by rolling it on the casters. To solve the above-noted drawbacks of such bags, the present inventor has developed a bag having the structure shown in FIG. 2. The bag shown in FIG. 2 has casters 21 fixed at a lower face of the bag body 24. To allow the bag body 24 to be self-standing in an upright position, the casters 21 are mounted at the four corners of the lower face. A grip 23A of handle 23 is placed at the center of the upper face of the bag body 24. As shown in FIG. 2, the bag of this structure is not moved by tilting it from a vertical position. As shown by the arrow of the FIG. 2, the bag is moved while standing in a vertical posture. When it is moved in the direction shown by the arrow, it can be moved through a narrow area. For this reason, it can be conveniently moved in plane cabins or in crowded areas. Furthermore, by using four free swiveling casters 21 which allow movement in any direction, the bag can be moved while upright and freely in any direction. The upright bag does not transmit the weight of the bag to the handle 23. Therefore, even a fairly heavy bag can be easily moved.

The bag shown in the FIG. 2, using the four casters described herein, has the advantage that it can be easily moved. However, with a bag of this structure, because the grip of the handle is pushed and moved horizontally, a force is applied to the bag body 24 and will deform it like a parallelogram as shown by the dotted line of FIG. 3. Since the vertical rods 23B of the handle 23 are extended to a high level and because the grip 23A is pushed horizontally in order to move the bag, the bag body 24 is strained by a strong bending moment resulting in deformation of the bag. Furthermore, because the bag can be rolled on any type of surface, when the bag is not rolled smoothly due to the unevenness of the rolling surface, an even stronger deforming force is applied to the bag body 24. For this reason, the bag body 24 needs to be able to resist the deformation of parallelogram shape shown by the dotted line.

Also, in order to allow easy motion of the bag, it is important to make the bag as light as possible. Even with bags mounted with casters, there are steps etc. that do not allow movement of the bag on the casters. In the places where the bag cannot be moved on the casters, it is necessary to lift the bag. For this reason, it is important to make the overall weight of the bag lighter to permit easy lifting. However, when the bag is made lighter, its mechanical resistance is reduced. For example, in order to effect a weight reduction, bags are often constructed by sewing cloth or plastic sheets, and therefore, the bags need to be partially reinforced because the material itself does not have sufficient strength to resist deformation. When is the bag is moved by pushing the grip horizontally, the bag needs to be reinforced by adding flat steel strips around the bag body to prevent parallelogram shape deformation of the bag body. Furthermore, bags made with hard paper, plastic sheets or metallic sheets, need thick and strong material to be used to prevent the parallelogram shape deformation. For this reason it is very difficult to make an overall light weight bag which can be moved while standing in an upright posture.

Further, an upright bag moving on casters needs a certain thickness to allow the bag to stand in a stable upright position. Particularly thin bags cannot stand upright and are unstable even with casters fixed at the four corners. This is because the casters of both sides are too close together. It is therefore always necessary to hold the grip of the bags which have little or no upright stability in order to prevent the bag from falling. Bags which are self-standing in an upright position are very convenient because they stand upright and are stable even if the grip is released. Thus, since it is not necessary to prevent the falling of the bag by holding the grip, the bag can be easily moved on the casters by pushing the grip horizontally. The drawback of the bag of this structure is that the body of the bag is made thicker, and gets deeper which in turns makes it inconvenient to insert and remove items at the bottom of the bag because the items placed at the top hinder the removal of the bottom items.

The present invention has been developed with the purpose to also solve this drawback, and an important object of the present invention is to provide a bag with a light bag body, which resists deformation when moved on the casters, and allows easy access to items placed inside the bag.

The above and further objects and features of the present invention will be more fully apparent from the following detailed description along with the accompanying drawings.

SUMMARY OF THE INVENTION

The present invention is directed to a bag provided with a bag body, casters mounted at the four corners of a lower face of the bag body to allow the moving of the bag body in a self-standing vertical posture, and a freely upwardly extensible handle fixed in the bag body. The handle has a grip at its upper extremity and vertical rods are connected to opposing ends of the grip. The vertical rods are inserted in guide-pipes fixed to the bag body, so that the rods can freely move in and out, and are mounted to the bag body through the guide-pipes. Further, the grip is positioned at the center or nearly at the center of an upper face of the bag body and is positioned on the bag body in the same direction as the longitudinal direction of the upper face of the bag body.

Furthermore, the bag of the present invention includes a partition which separates or divides the interior of the bag body into two compartments. The partition also functions to reinforce the bag body so as to prevent parallelogram shape deformation. The partition is connected to one part or the totality of the circumference of the bag body. The bag body is provided with covers which allow independent and separate opening and closing of each compartment. The opening and closing of the covers allows items to be separately removed from and inserted into the two compartments.

The bag of the present invention is made lighter in weight and is also able to prevent deformation when moved on the casters. This is because the partition is fixed to an interior surface of the bag body. The partition which is fixed inside the bag body effectively prevents the parallelogram shape deformation of the bag body when the grip of the handle is pushed. The bag, which includes the partition, does not need to have a body extremely strongly designed and thus can be made light weight.

Further, the bag includes the partition which divides the bag body into compartments and the covers which allow the opening of both sides of the bag body. The interior of the bag body is separated into two compartments, thereby allowing convenient access to items in each compartment.

The partition is formed of a suitable hard panel. The guide pipes are fixed to the surface of the hard partition through fastening devices or saddles.

The partition can be made of two sheets forming the hard panel. With this type of partition it is possible to fix the guide pipes between the hard panels.

The bags of the present invention fix the handle by a strong structure to the bag body. The guide pipes that connect the handle are positioned along the partition so that the guide pipes do not hinder access to the inside the bag body so that it can be conveniently used. Also, the guide pipes that are fixed to the partition also serve to reinforce the partition, for example, when heavy items are placed into the bag by placing them on the partition, they can be safely placed.

The above and further objects and features of the present invention will be more fully apparent from the following detailed description along with the accompanying drawings.

DETAILED DESCRIPTION OF THE INVENTION

Figure 1:
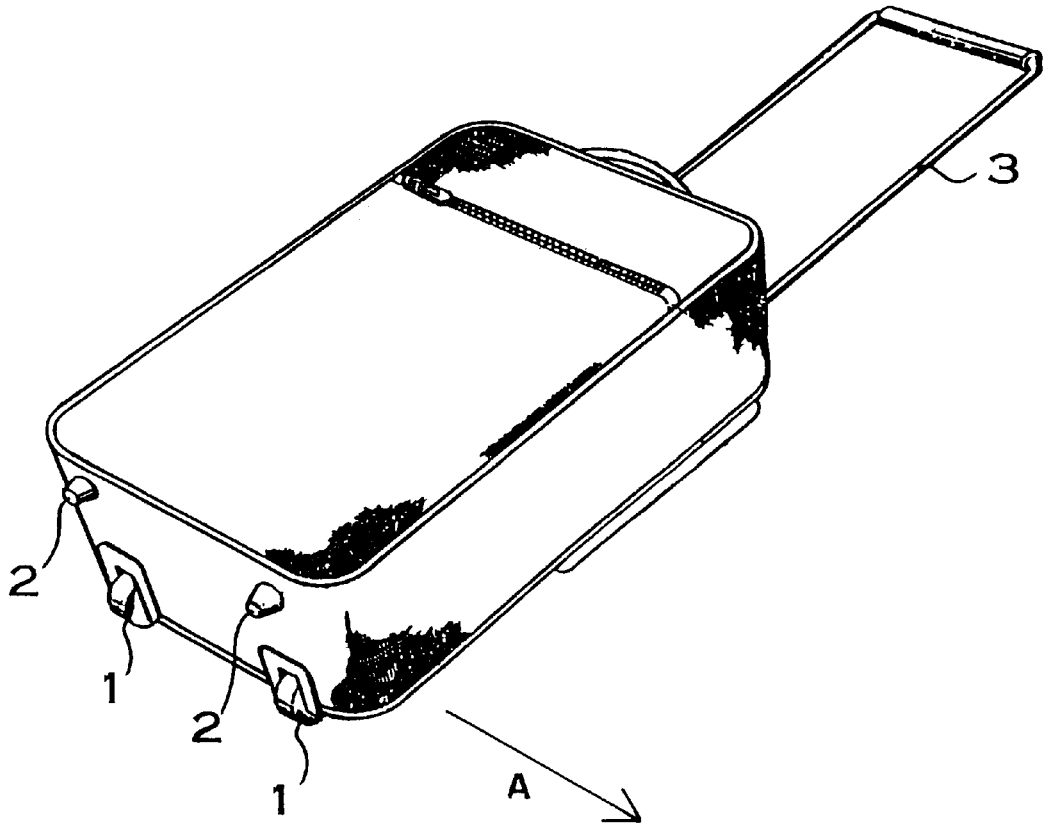
FIG. 1 PRIOR ART
FIG. 1 is an oblique view showing a prior art bag with casters.
Figure 2:
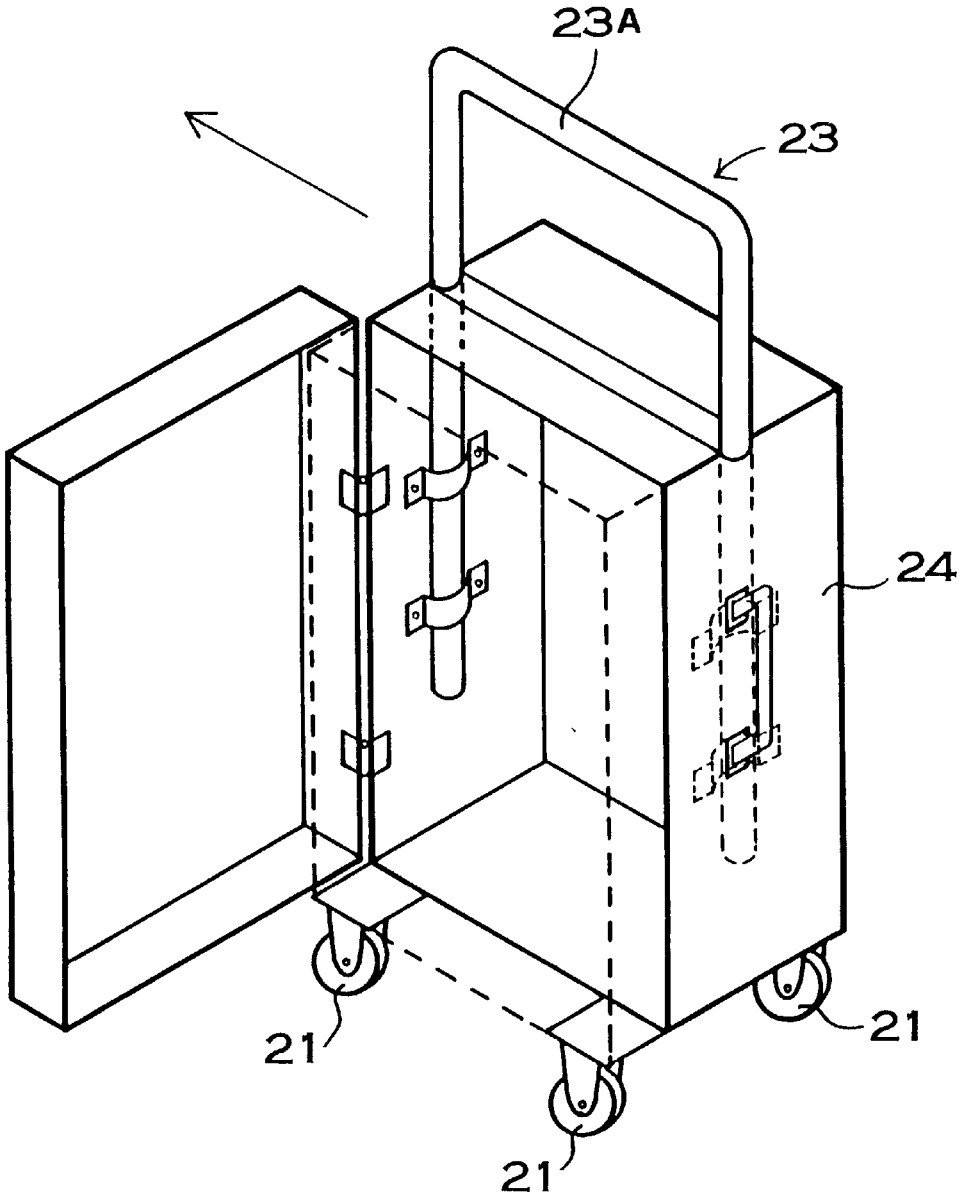
FIG. 2 is an oblique view of the bag formerly developed by the present inventor.

The bag shown in FIG. 4 to FIG. 7 includes a caster support 45 fixed to a lower face of a bag body 44 and casters 41 fixed to the four corners of the caster support 45. A grip 43 is mounted in the bag body 44 so that it can be vertically retracted in the bag body 44 or extended vertically in a direction away from the bag body 44.

The bag body 44 is composed of a lower face 44A, vertical faces 44B on both sides that are connected on both extremities of the lower face 44A and of an upper face 44C connected to the upper extremities of the vertical faces 44B. The bag body 44 has a vertical rectangular shape composed of the lower face 44A, the vertical faces 44B and the upper face 44C, and the bag body is open on both sides.

The bag is a cabin type bag which allows the bag to be stowed inside of the cabin of a plane, and also a large size type bag frequently used when traveling. The cabin type bag, with casters included, is slightly smaller than the maximum size allowed on board planes. At present, the maximum size of the bags allowed on board planes is fixed at 50×35×20 cm. Therefore, the outer dimensions of the cabin type bag are smaller than the above-mentioned maximum dimensions.

Furthermore, to make the bag stand by itself in an upright position and to make it movable with a large amount of items inside the bag, the bag thickness is best set at over 10 cm, the width that is to say the distance between the upper face and the lower face of the bag is best to be set at 20 cm. The size of the lower face of the bag should be preferably over 10×20 cm to allow stable movement of the bag while in a vertical posture. The large size cabin type bag allowing the storage of many items, has a width of 20 cm and a side of 35 cm. The cabin type bag is comparatively compact and has a width of 15 cm and a side of 25 to 30 cm. The overall height of the cabin type bag is under 50 cm with the casters included. The cabin type bag has a bag body height of 30 to 35 cm.

The large travel bag that is not a cabin type bag has a lower face of 20 to 40 cm in width, a side width of 1.5 to 3 times and a height of 40 to 60 cm.

The bag body 44 is provided with a square type reinforcement frame 47A at the inner face, as shown in the enlarged cross-sectional view of FIG. 7. A hard lining 47B and a smooth surface material 48 are applied on the surface of the reinforcement frame.

The reinforcement frame is a hard plastic panel of hard vinyl chloride resin or polypropylene reinforced by the introduction of many wires 47C, and bent like a frame along the inner face of the bag body 44. The reinforcement frame 47A of FIG. 8 is provided with square holes 421 extending vertically in the hard plastic panel. The wires 47C are introduced into the square holes 421 and strongly reinforce the hard plastic panel. A thickness of for example 2 to 4 mm is used for the wires 47C. The reinforcement frame 47A of this structure is light and strong. However, aluminum and thin metal sheets can also be used for the reinforcement frame. The hard lining 47B is formed of a thick paper panel or a thin and hard plastic panel. The hard lining 47B can be made laminated with many layers of the same material or different materials. The bag shown in FIGS. 5 and 7 has a reinforcement frame 47A and a hard lining 47B made of different materials, but, both can be formed in one piece. Furthermore, the bag shown in FIG. 7, can also omit the reinforcement frame.

The smooth surface material 48 is made of a cloth or plastic sheet. At the middle of a lateral face of the smooth surface material of the bag body 44, a natural or a synthetic leather belt can be sewn on as decoration material.

Figure 5:
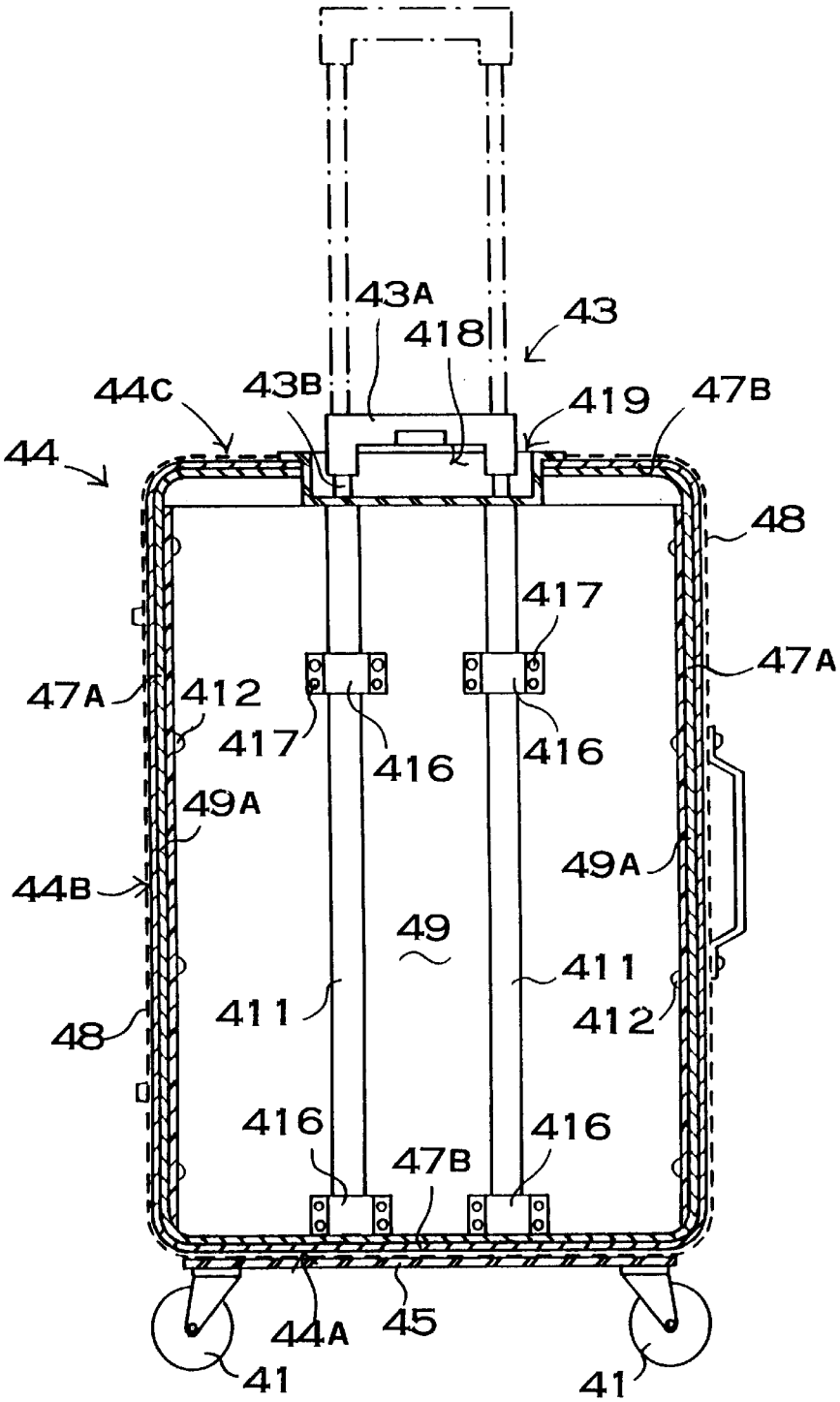
FIG. 5 is a vertical cross-sectional view of the bag shown in FIG. 4.
Figure 6:
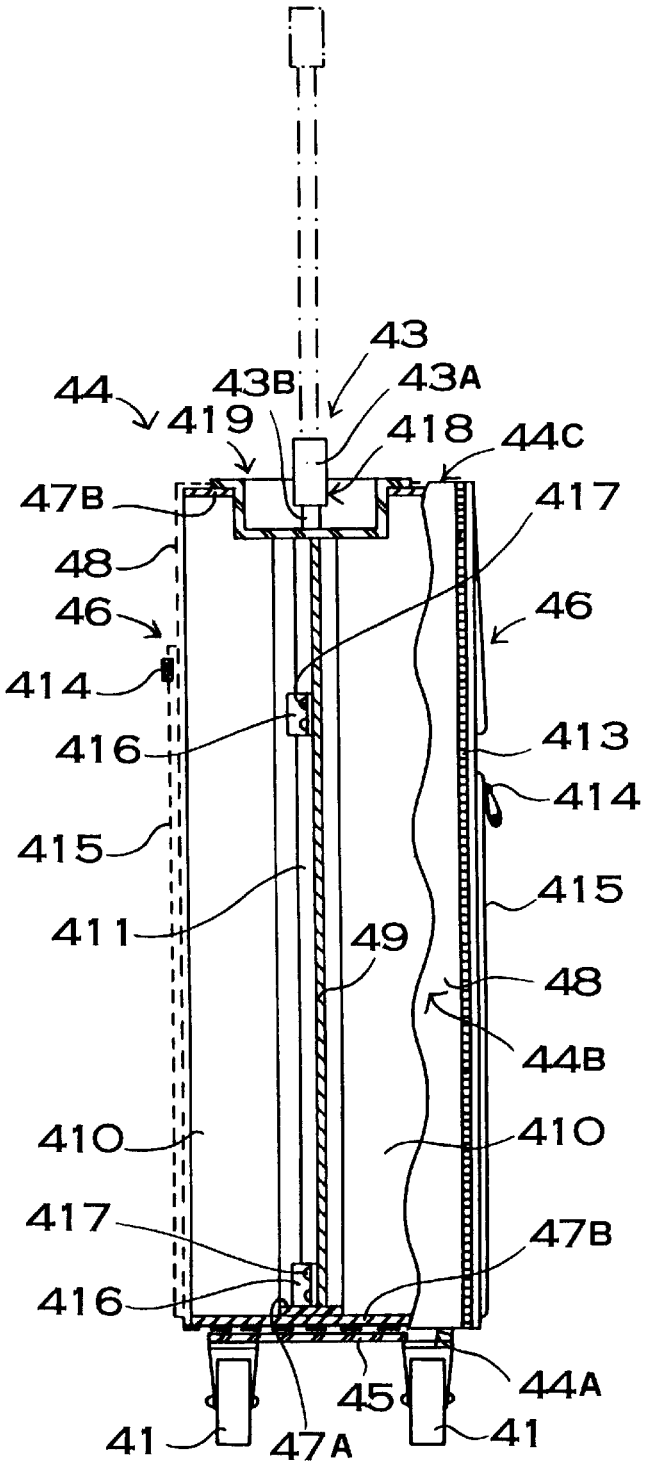
FIG. 6 is a partial cross-sectional lateral view of the bag shown in FIG. 4.

Further, the bag body 44 composed of the lower face 44A, the lateral faces 44B and the upper face 44C, is divided by a partition 49 into two interior compartments 410, as shown in the cross-sectional views of FIG. 5 and FIG. 6. The partition 49 divides the interior of the bag body 44 into one compartment 410 on each side of the partition which also reinforces the inside of the bag body 44 composed of the lower face 44A, the lateral faces 44B and the upper face 44C. Also, guide pipes 411 are fixed on the partition.

A hard panel made of ABS resin plastic is used for the partition 49. The partition 49 has an outer circumference generally conforming to the inner peripheral surfaces of the lower face 44A, the lateral faces 44B and the upper face 44C. The partition is fixed to the inner side of the bag body 44 and is used to reinforce it. The partition 49 is made of an ABS resin hard panel so as to be light and strong. However, the bag of the present invention is not limited to a partition material of ABS resin. For example, vinyl chloride resin, nylon, acrylic resin, polyethylene resin, epoxy resin etc. can also be laminated and used for the partition. Furthermore, it is also possible to use a transparent plastic sheet as the partition. A transparent partition allows a user to see items placed in the compartment on the other side of the partition. Also, aluminum or metal sheet like steel, can be used for the partition, instead of the plastic sheet. Since the plastic sheet or metal sheet partition has sufficient resistance, several perforations can be employed in order to reduce the weight of the bag.

Figure 3:
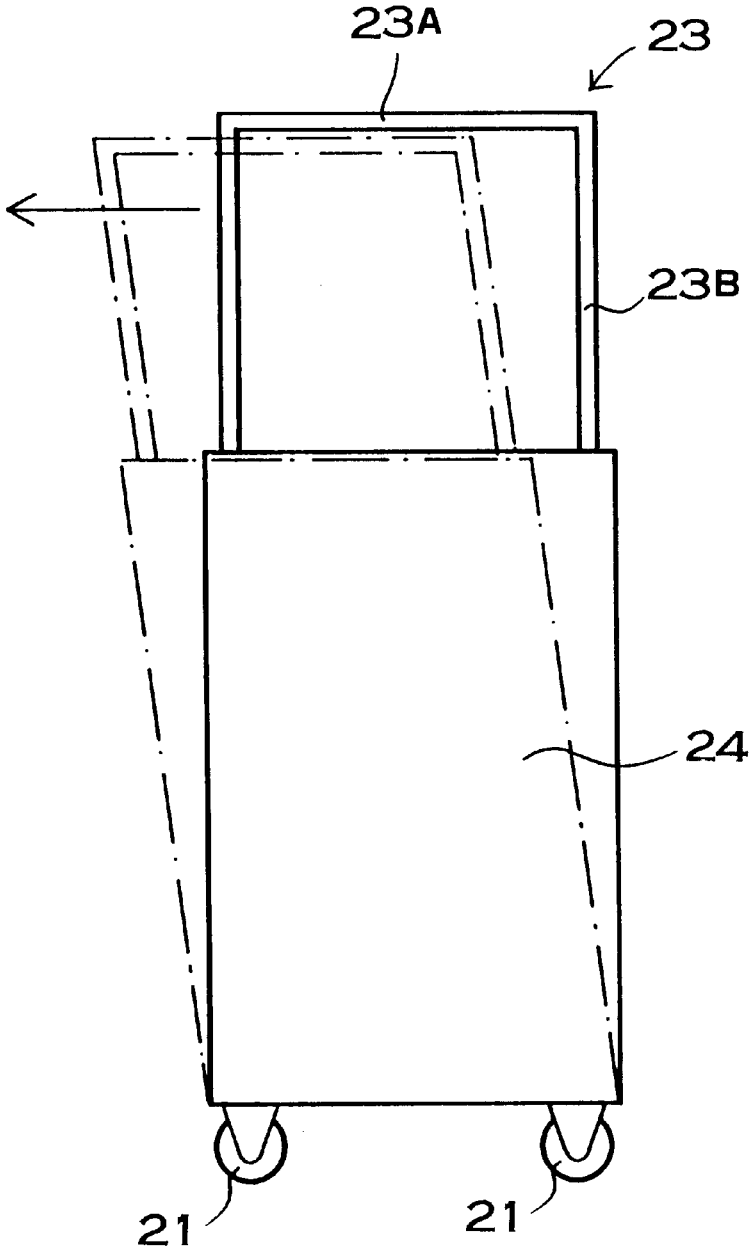
FIG. 3 is a front view showing the condition of deformation of the bag shown in the FIG. 2.

Furthermore, resistant sheet materials like cloth, plastic sheet or nonwoven fabric can be used for the partition. The sheet material should have sufficient resistance to traction and should not be stretchable, because if the sheet material of the partition stretches, the bag body will deform. The partition of sheet material is connected to an interior surface of the bag body in order to prevent deformation of the bag body in the direction shown in FIG. 3. It is not possible to directly connect the partition of sheet material to the guide pipes. For this reason, the reinforcement frame is fixed inside the bag body and the guide pipes are connected to the reinforcement frame.

FIG. 7 shows the connection of the partition 49 that is a hard panel, to the vertical face 44B of the bag body 44. Opposing sides of the partition 49 are each formed with a bent piece 49A, and each bent piece 49A is fixed to an inner face of the bag body 44. The partition that is a hard panel can also be connected to the inner face of the bag body as a panel without being bent, through the use of L-shaped fixing devices. One end of each L-shaped fixing device is fixed to the partition and the other end is fixed to the inner face of the bag body. Then, the sheet material partition is fixed on the reinforcement frame by gluing or sewing. The reinforcement frame is connected to the bag body by the L-shaped fixing devices.

The bent piece 49A or the L-shaped fixing devices of the partition 49 are fixed by rivets 412 or screws penetrating through the bag body 44. The rivets 412 or screws fixing the partition 49, hold tightly the partition 49 and the L-shaped fixing devices, the hard lining 47B, the smooth surface material 48, and the decoration material so as to fix the partition 49, the hard lining 47B, the smooth surface material and the decoration material. The partition 49 is at least fixed between the upper parts and lower parts of both sides in the vertical surfaces 44B of the bag body 44. Furthermore, the upper edge of the partition, can also be connected to the upper face of the bag body and the lower edge to the lower face. The partition which is connected to the vertical faces, to the upper face and to the lower face will reinforce the bag body even more strongly.

As shown in cross-sectional views of FIG. 6 and FIG. 7, the partition 49 is positioned and fixed at the middle or almost at the middle of the bag body 44. This is because, inside the bag body 44, the compartments 410 have almost the same capacity. But it is not necessary to make both compartments 410 exactly the same capacity, that is to say to with the same depth. For example, the bag shown in FIG. 6 and FIG. 7, has one compartment 410 which is a little deeper than the other compartment 410.

Figure 4:
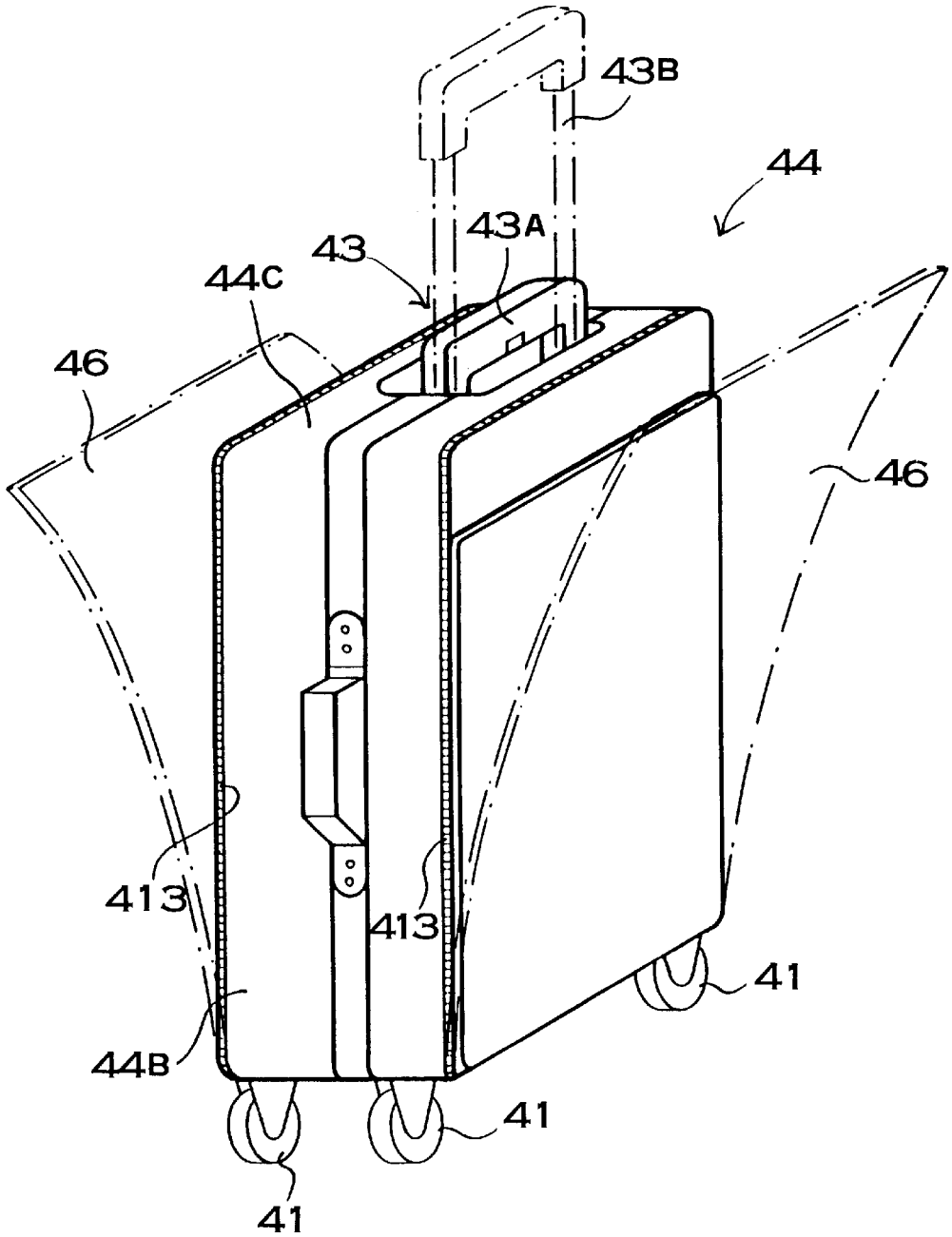
FIG. 4 is an oblique view of a bag constructed in accordance with an embodiment of the present invention.

Furthermore, the bag shown in the FIG. 4 has a cover 46 on each side that allows independent opening and closing of the two compartments 410 of the bag body 44. To allow the opening of the whole face of the bag body 44, the lower faces of the covers 46 are connected to the bag body so that they can be folded, the edges of both sides and the upper edge are connected by a slide fastener or zipper 41 to the opening edge of the vertical faces 44B and of the upper face 44C of the bag body 44. On the surface of the cover 46 shown in FIG. 6, a pocket 415 is provided and is itself provided with a fastener or zipper 414 at its opening. It is also possible to provide a pocket in the inner face of the cover.

The handle 43 is composed of the horizontal grip 43A connected at the extremities of the two vertical rods 43B, and has a U-shape. Through the two guides pipes 411, the two vertical rods 43B are mounted so that they can be pushed inwardly and pulled outwardly of the bag body 44. The guide pipes 411 are fixed to the partition 49 of the bag body 44. The guide pipes 411 are pipes allowing the vertical rods 43B to be pushed in and pulled out with friction.

The guide pipes 411 are fixed on the surface of the partition 49 that is fixed almost at the middle of the bag body 44, setting the grip 43A such that it is located between the two upper extremities of the vertical rods 43B, almost at the middle of the upper face of the bag. As shown in the cross-sectional views of FIG. 5 and FIG. 7, the guide pipes 411 are fixed to the surface of the partition 49 through the saddles 416 or by a gluing process (not shown). The saddles are fixed to the partition 49 through the rivets 417 or by gluing.

Figure 9:
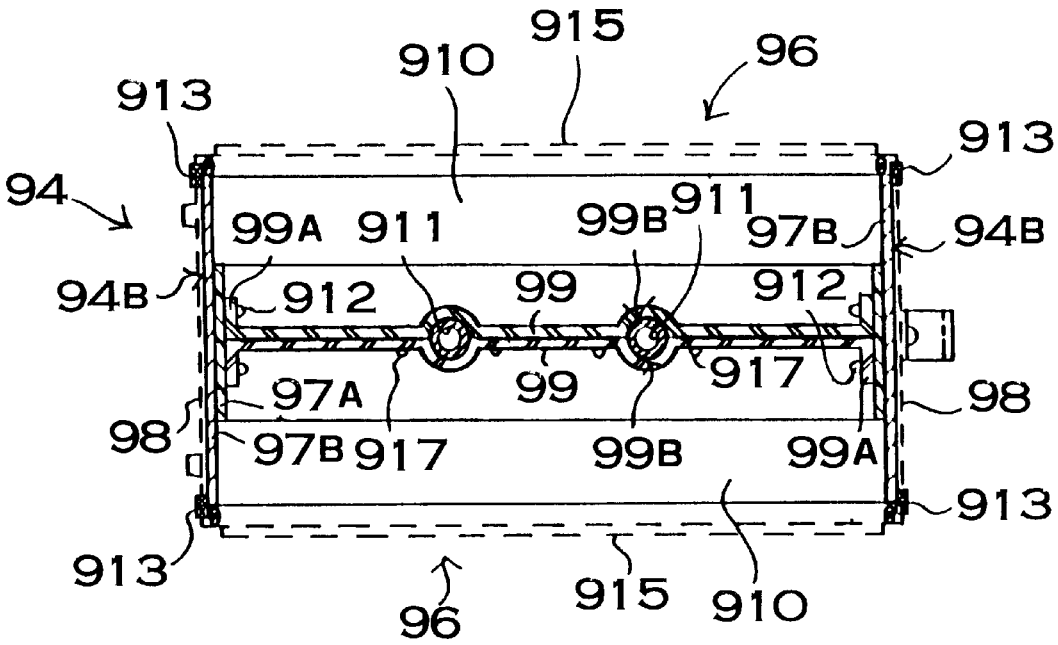
FIG. 9 is a horizontal cross-sectional view showing another structure for connecting guide pipes to a partition.

As shown in the FIG. 9, the guide pipes can be held between two partitions 99 connected to the bag body 94. The partitions 99 are made with a hard panel like a plastic panel or a metallic panel etc. and is formed with insertion holes 99B for the guide pipes 911. The guide pipes 911 are inserted in the holes 99B of the two hard panels that form the partition 99 and are fixed by rivets 417 or by screws so as to vertically fix the guide pipes 911. The advantage of the partition 99 of this structure is that the guide pipes are strongly secured in order to avoid any movement. Although it is not shown in the figures, the guide pipes can also be secured at the lower face of the bag body. The guide pipes fixed at the lower face are even more strongly secured to the bag body.

When the bag is moved on the casters 41, as shown by the dotted line in FIG. 5, the handle 43 is pulled out of the bag. When the bag is not moved by the casters 41, the handle 43 is pushed into the bag. As shown by the full line of FIG. 5, when the handle 43 is pushed into the bag body 44, the handle 43 forms a grip aperture 418 between the grip 43A and the upper face 44C of the bag body 44. The bag is provided with a slot 419 at the upper face 44C such that when the handle 43 is pushed into the bag body 44, the grip aperture 418 is defined between the grip 43A and the upper face 44C of the bag body 44.

The handle 43 is stopped by stoppers (not shown) in the pulled out or extended position, and also in the pushed in or retracted position. When the grip 43A is pushed so as to move the bag on the casters 41, the handle 43 is stopped at the extended position to allow a user to lean on the grip 43A. In other words, the bag can be used as a walking stick. When the bag is used like this, the handle 43 is prevented by stoppers from being pushed into the bag. The handle 43 is also stopped in the retracted position when the bag is lifted and transported by grabbing the grip 43A of the handle 43.

When the handle 43 is fully extended, the overall length of the vertical rods 43B is designed so that, from the bottom of the casters 41 to the grip 43A, the height is 80 cm. However, it is also possible to set the height from the bottom of the casters 41 to the grip 43A, in the span of 60 to 100 cm. When the height of the grip 43A is 80 cm, the bag can be the most easily pushed. The grip 43A, connected to the upper extremity of the vertical rods 43B, extends in the direction of the long side of the upper face 44C of the bag. The grip 43A is maintained in a horizontal position by pulling out the two vertical rods 43B of the same length.

Figure 10:
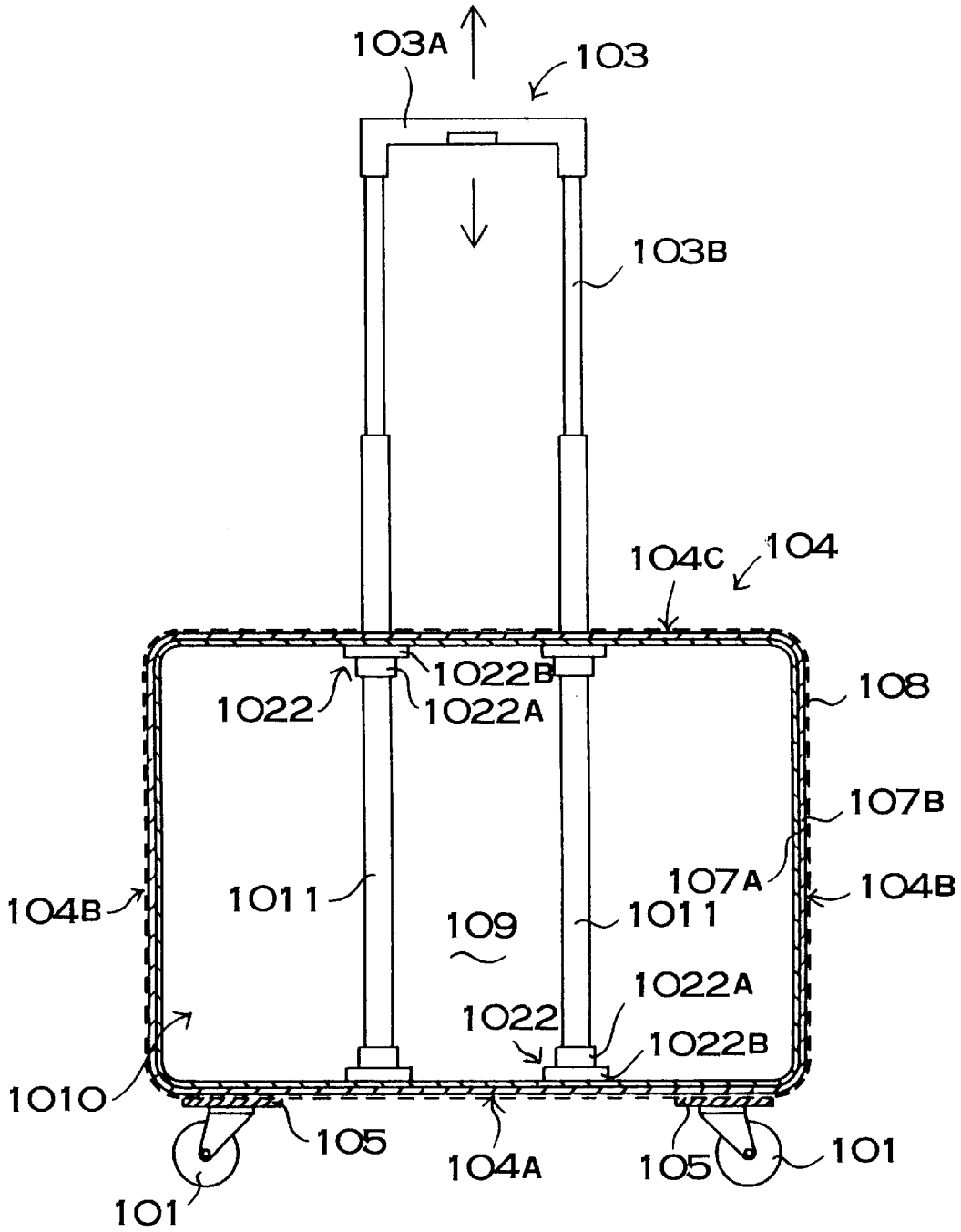
FIG. 10 is a vertical cross-sectional view showing an example of the structure connecting the guide pipes to the bag body.

FIG. 10 illustrates a bag in which the guide pipes are not fixed to the bag body through a partition. In the bag shown in FIG. 10, the reinforcement frame 107A is fixed to the inner face of the body bag 104. For the reinforcement frame 107A, the same structure as for the bag shown in the FIG. 7, can be used. The bag shown in FIG. 10, like the bag shown in the cross-sectional view of the FIG. 6, has a partition 109 made of a stretch resistant material set inside the bag body 104 and dividing the inside of the bag body 104 into the two compartments 1010. The circumference of the partition 109 is connected to the reinforcement frame 107A to prevent parallelogram shape deformation of the reinforcement frame 107A. The partition 109 is held between the reinforcement frame 107A and the hard lining 107B, or connected to the reinforcement frame through a fixing device. The fixing device with an L-shaped cross section, has one extremity sewed or glued to the partition and the other extremity screwed or glued, etc. to the inner face of the reinforcement frame and fixes the partition to the reinforcement frame.

The guide pipes 1011 of the handle 103 penetrate through the upper side of the reinforcement frame 107A, and do not penetrate through the lower side of the reinforcement frame 107A but are connected to the reinforcement frame 107A through the attachments 1022. The attachments 1022 are made of plastic, and the guide pipes 1011 are introduced into the cylindrical parts 1022A built in one piece with the flanges 1022B. The attachments 1022 of this structure, hold the guide pipes 1011 in the cylindrical parts 1022A and the flanges 1022B are fixed by screwing or gluing to the inner face of the reinforcement frame 107A so as to fix the guide pipes 1011 to the bag body 104.

Furthermore, the bag is mounted with the casters 101 fixed at the four corners of the lower face 104A of the bag body 104. The casters 101 are fixed to the caster support 105. The caster support 105 is fixed to the lower face of the bag body 104. The caster support 105 has almost the same dimensions as the lower face 104A of the bag body 104 and is fixed to the lower face 104A of the bag body 104 by screws or rivets. However, it is also possible to divide the caster support into two pieces in order to reduce the overall weight of the bag. To provide sufficient strength to the caster support 105, aluminum or metal sheet etc. are used. The desirable thickness of the caster support 105 made of aluminum is from 2 to 5 mm and furthermore from 3 to 4 mm. To make the caster support 105 lighter, perforation holes can be employed.

The caster support 105 fixes the casters 101. The casters 101 are positioned at the four corners of the lower face 104A of the bag body 104 and are fixed to the caster support 105. The casters 101 which are usually called universal casters are used because they can freely swivel. It is also possible to use two freely swiveling casters on one side of the bag body and two non-swiveling casters on the other side. The casters 101 are fixed to the lower face of the caster support 105 through rivets or screws.

Figure 11:
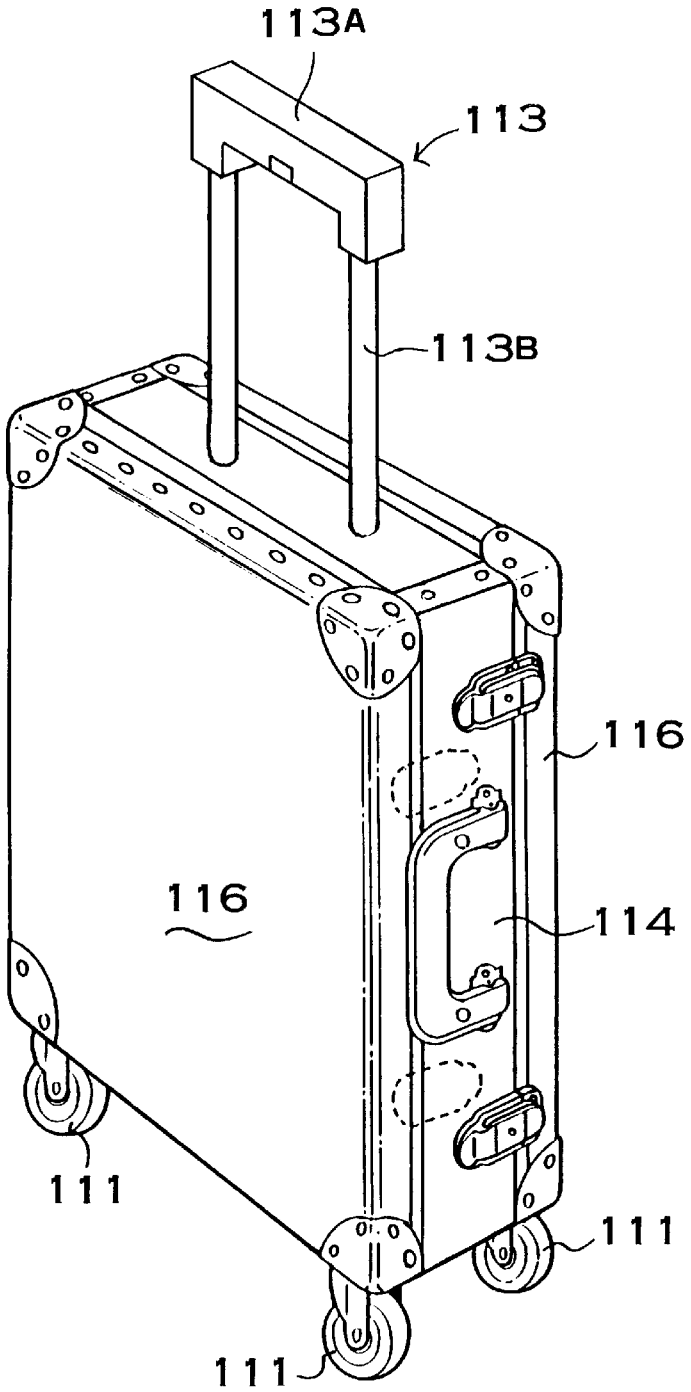
FIG. 11 is an oblique view of the bag of another embodiment of the present invention.

The bag of the present invention does not specify the bag body with the above-mentioned structure. As shown in the FIG. 11 and FIG. 12, the bag body can also have a structure connecting a cover 116 allowing the opening and the closing through the wing nuts 1120. In this bag, the bag body 1 4 and the covers 116 are made of hard material of sufficient resistance, for example, a panel made with a material composed of fibrous material hardened with a binder, a coating material made of hard waterproof paper with the surface coated, hard plastic, aluminum or other sheet metal. The thickness of the bag body 114 and the covers 116 is designed to resist deformation due to the introduction of fairly heavy items.

Figure 12:
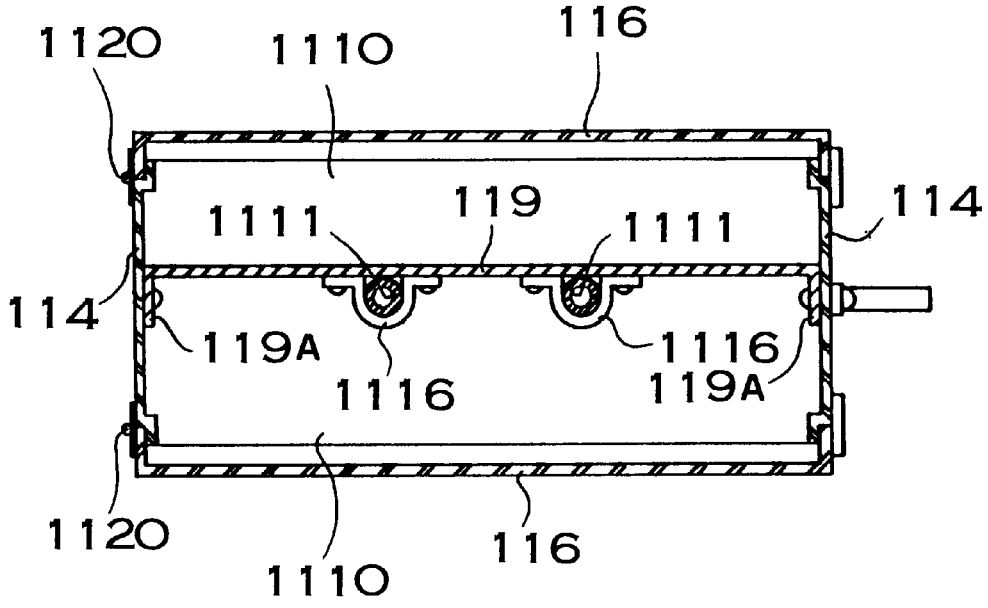
FIG. 12 is a horizontal cross-sectional view of the bag shown in FIG. 11.

As shown in the cross-sectional view of FIG. 12, the bag has a partition 119 made with a hard panel fixed inside the bag body 114 and dividing the interior of the bag into two compartments 1110. The partition 119 is fixed to the bag body 114 by the bent piece 119A on each side. Then, in this bag, the guide pipes 1111 are fixed to the partition 119 through saddles 1116, and the vertical rods 113B of the handle 113 are inserted into the guide pipes 1111. Furthermore, in this bag, the casters 111 are fixed at the four corners of the lower face of the bag body 114. The important features of this bag are that it is a very strong structure reinforced by the bag body 114, the covers 116 on each side and the partition 119 made with a hard panel.

As the present invention may be embodied in several forms without departing from the spirit or essential characteristics thereof, the present embodiment is therefore illustrative and not restrictive, since the scope of the invention is defined by the appended claims rather than by the description preceding them, and all changes that fall within the metes and bounds of the claims, or the equivalence of such metes and bounds thereof are therefore intended to be embraced by the claims.

I claim:

1. A bag comprising:

a bag body including a first side, a second side, an upper side connecting upper ends of said first and second sides, and a lower side connecting lower ends of said first and second sides;

a first cover connected to said bag body and covering a first open side of said bag body;

a second cover connected to said bag body and covering a second open side of said bag body, wherein each of said first and second covers are independently openable and closable;

a rigid support frame connected to interior peripheral surfaces of said first, second, upper, and lower sides of said bag body;

a partition disposed within said rigid support frame so as to define first and second interior compartments, said partition serving to reinforce said bag body to prevent deformation thereof;

four freely swiveling casters mounted at four corners of said lower side of said bag body to facilitate movement of said bag body while in a self-standing upright position so as to be capable of freely running in all directions;

a first guide pipe connected to a side surface of said partition;

a second guide pipe connected to the side surface of said partition and spaced from said first guide pipe, wherein said first and second guide pipes extend to a lower edge portion of said partition; and a handle movably mounted in said bag body, said handle including a first rod slidably received in said first guide pipe, a second rod slidably received in said second guide pipe, and a grip interconnecting an upper end of said first rod and an upper end of said second rod, wherein said first and second rods extend through an upper face of said bag body and can be moved inwardly and outwardly of said bag body.

2. The bag as claimed in claim 1, wherein said partition is formed of a hard material.

3. The bag as claimed in claim 2, wherein said partition is formed of a hard plastic material.

4. The bag as claimed in claim 3, wherein said partition is transparent.

5. The bag as claimed in claim 1, wherein said partition is formed of metal.

6. The bag as claimed in claim 5, wherein said metal forming said partition is aluminum.

7. The bag as claimed in claim 1, wherein opposing end portions of said partition comprise an angled portion for fixing said partition to inner surfaces of said bag body.

8. The bag as claimed in claim 1, wherein said partition is fixed to an inner surface of said bag body by means of at least one L-shaped fixing device.

9. The bag as claimed in claim 1, wherein said partition is positioned and fixed in said bag body such that said partition is located approximately at a middle portion of said bag body so that said first and second compartments have substantially the same capacity.

10. The bag as claimed in claim 1, wherein:

each of said first and second covers are connected to said bag body along a lower peripheral edge of said covers, each of said first and second covers are releasably connected to said bag body by means of a slide fastener along an upper peripheral edge, a first peripheral side edge, and a second peripheral edge of said first and second covers, and when said slide fastener is released, each of said covers can pivot about said lower peripheral edges.

11. The bag as claimed in claim 1, wherein said partition comprises two rigid panels, and said guide pipes are interposed between said panels.

12. The bag as claimed in claim 1, further comprising a caster support connected to an outer surface of said lower side of said bag body, wherein said casters are fixed to said caster support.

13. A bag comprising:

a bag body including a first side, a second side, an upper side connecting upper ends of said first and second sides, and a lower side connecting lower ends of said first and second sides;

a first cover connected to said bag body and covering a first open side of said bag body;

a second cover connected to said bag body and covering a second open side of said bag body, wherein each of said first and second covers are independently openable and closable;

a rigid support frame connected to interior peripheral surfaces of said first, second, upper, and lower sides of said bag body;

a partition disposed within and connected to said rigid support frame so as to define first and second interior compartments, said partition serving to reinforce said bag body to prevent deformation thereof;

four casters mounted at four corners of said lower side of said bag body to facilitate movement of said bag body while in a self-standing upright position;

a first guide pipe having a lower end secured to an inner peripheral surface of said rigid support frame;

a second guide pipe having a lower end secured to an inner peripheral surface of said rigid support frame, said second guide pipe being spaced from said first guide pipe; and a handle movably mounted in said bag body, said handle including a first rod slidably received in said first guide pipe, a second rod slidably received in said second guide pipe, and a grip interconnecting an upper end of said first rod and an upper end of said second rod, wherein said first and second rods extend through an upper face of said bag body and can be moved inwardly and outwardly of said bag body.

14. The bag as claimed in claim 13, wherein said first and second guide pipes extend through an upper portion of said reinforcement frame and are fixed to a lower portion of said reinforcement frame without penetrating through said lower portion.

15. The bag as claimed in claim 13, wherein each of said plurality of casters can freely swivel.

16. The bag as claimed in claim 13, wherein said four casters comprises two swiveling casters located at a first side of said lower side of said bag body, and two non-swiveling casters located at a second side of said lower side of said bag body.

* * * * *

UNITED STATES PATENT AND TRADEMARK OFFICE

CERTIFICATE OF CORRECTION

PATENT NO. : 5,950,779
DATED : September 14, 1999
INVENTOR(S) : Etsuo Miyoshi

Figure 7B:
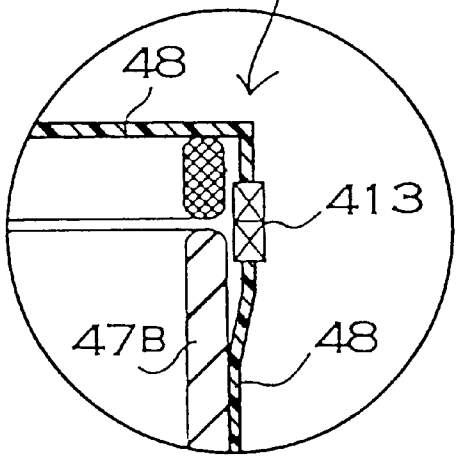
FIG. 7 is a horizontal cross-sectional view of the bag shown in FIG. 4.
Figure 7A:
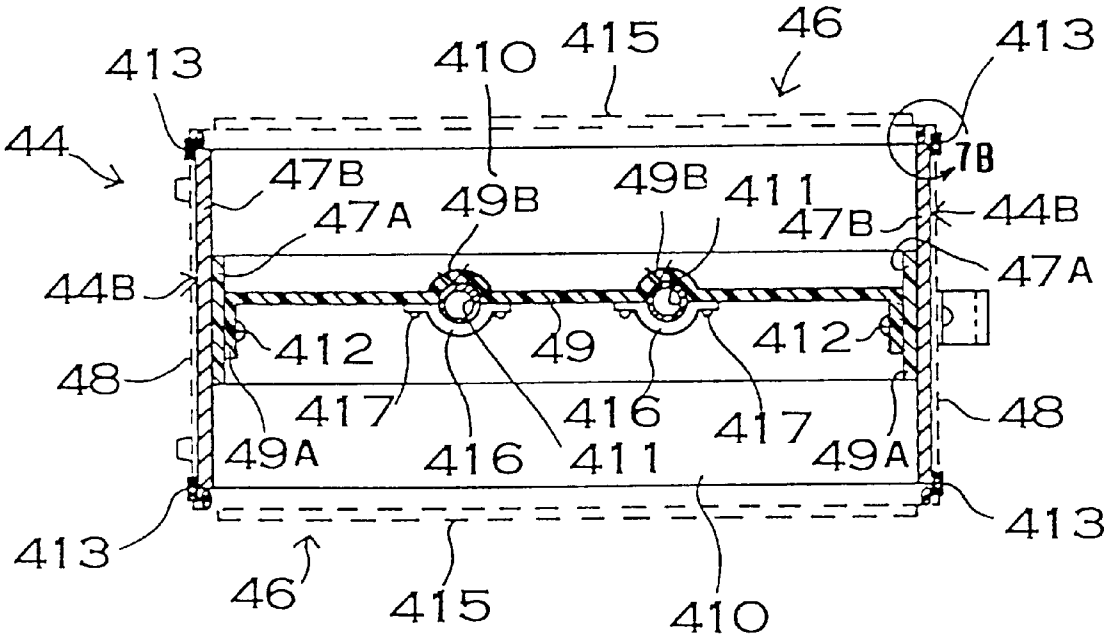
Figure 8:
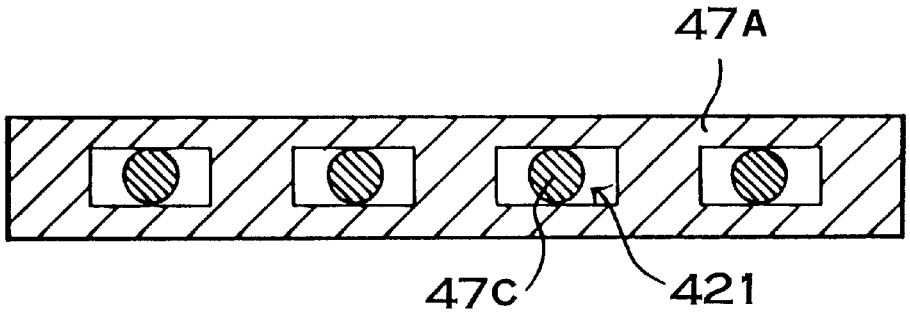
FIG. 8 is an enlarged cross-sectional view of the reinforcement frame shown in FIG. 4.

It is certified that error appears in the above-identified patent and that said Letters Patent is hereby corrected as shown below:

Column 4,
Lines 1-2, rewrite as follows:
-- Fig. 7A is a horizontal cross-sectional view of the bag shown in Fig. 4, and Fig. 7B is an enlarged view of the portion of the bag shown in Fig. 7A. --

Column 5,
Line 60, change "Fig. 7 shows" to -- Figs. 7A-B show --.

Column 6,
Lines 21 and 28, change "Fig. 7," to -- Fig. 7A, --.
Line 30, change "the Fig. 4" to -- Figs. 4 and 7A --.
Line 32, change "To" to -- Also, as shown in Fig. 7B, to --.
Line 35, insert -- and --before "the" (third occurrence).
Line 56, change "7" to -- 7A, --.

Signed and Sealed this

Thirtieth Day of April, 2002

*Attest:*

*Attesting Officer*

JAMES E. ROGAN
*Director of the United States Patent and Trademark Office*